US010240467B2

(12) United States Patent
Tatman et al.

(10) Patent No.: US 10,240,467 B2
(45) Date of Patent: Mar. 26, 2019

(54) ANTI-ROTATION LUG FOR A GAS TURBINE ENGINE STATOR ASSEMBLY

(75) Inventors: Neil L. Tatman, Brentwood, NH (US); Richard K. Hayford, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 768 days.

(21) Appl. No.: 13/565,950

(22) Filed: Aug. 3, 2012

(65) Prior Publication Data

US 2014/0037442 A1 Feb. 6, 2014

(51) Int. Cl.

| | |
|---|---|
| ***F01D 9/04*** | (2006.01) |
| ***F01D 25/24*** | (2006.01) |
| ***F01D 11/08*** | (2006.01) |

(52) U.S. Cl.

CPC ..... *F01D 9/042* (2013.01); *F01D 11/08* (2013.01); *F01D 25/246* (2013.01); *F05D 2240/11* (2013.01); *F05D 2260/30* (2013.01); *Y10T 29/49245* (2015.01); *Y10T 74/20636* (2015.01)

(58) Field of Classification Search

CPC ..... F01D 9/04; F01D 9/042; F01D 25/246; F01D 11/08; F05D 2240/10; F05D 2240/90; F05D 2240/91

See application file for complete search history.

(56) References Cited

U.S. PATENT DOCUMENTS

| | | | | |
|---|---|---|---|---|
| 2,915,281 | A | 12/1959 | Ridley et al. | |
| 3,104,091 | A | 9/1963 | Dennis | |
| 3,578,344 | A | 5/1971 | Yost | |
| 3,708,076 | A * | 1/1973 | Radwill | 213/67 R |
| 4,687,413 | A | 8/1987 | Prario | |
| 4,856,963 | A | 8/1989 | Klapproth et al. | |
| 5,004,402 | A | 4/1991 | Burchette et al. | |
| 5,249,920 | A | 10/1993 | Shepherd | |
| 5,584,654 | A | 12/1996 | Schaefer et al. | |
| 5,775,874 | A * | 7/1998 | Boite | F01D 25/246 415/209.1 |
| 5,918,461 | A | 7/1999 | Bacon | |
| 6,679,678 | B2 | 1/2004 | Giesler et al. | |

(Continued)

FOREIGN PATENT DOCUMENTS

| | | |
|---|---|---|
| GB | 2309053 | 7/1997 |
| JP | 2003184507 A | 7/2003 |

(Continued)

OTHER PUBLICATIONS

Mason, Betsy, "10 Great Racetracks As Seen From Space", Jun. 29, 2010, (http://www.wired.com/2010/06/gallery-racetracks/).*

(Continued)

*Primary Examiner* — Ninh H Nguyen

*Assistant Examiner* — Brian P Wolcott

(74) *Attorney, Agent, or Firm* — Carlson, Gaskey & Olds, P.C.

(57) ABSTRACT

A stator assembly includes a case including an arcuate wall having an aperture with circumferentially spaced first lateral surfaces. A stator vane has an outer platform with a notch. An anti-rotation lug has a base that is received in the notch and a boss extends from the base. The boss is received in the aperture. The boss has second lateral surfaces that engage the first lateral surfaces in an interference fit relationship.

11 Claims, 4 Drawing Sheets

(56) References Cited

U.S. PATENT DOCUMENTS

| | | | | |
|---|---|---|---|---|
| 6,901,821 | B2 * | 6/2005 | Torrance et al. | 74/574.4 |
| 7,032,904 | B2 | 4/2006 | Rogers | |
| 7,144,218 | B2 * | 12/2006 | Dube et al. | 415/189 |
| 7,334,980 | B2 | 2/2008 | Trinks et al. | |
| 2005/0281694 | A1 | 12/2005 | Rogers | |
| 2006/0153683 | A1 | 7/2006 | Dube et al. | |
| 2009/0246012 | A1 | 10/2009 | Shapiro et al. | |
| 2012/0128481 | A1 | 5/2012 | Baumas | |
| 2013/0078086 | A1 | 3/2013 | Breugnot et al. | |

FOREIGN PATENT DOCUMENTS

| | | |
|---|---|---|
| WO | 9525879 | 9/1995 |
| WO | 20130122878 | 8/2013 |

OTHER PUBLICATIONS

International Search Report and Written Opinion for International Application No. PCT/US2013/049855 completed on Oct. 8, 2013.
International Preliminary Report on Patentability for International Application No. PCT/US2013/049855 dated Feb. 12, 2015.
Extended European Search Report for European Application No. 13825230.9 dated Aug. 7, 2015.

* cited by examiner

ANTI-ROTATION LUG FOR A GAS TURBINE ENGINE STATOR ASSEMBLY

BACKGROUND

This disclosure relates to an anti-rotation lug for a gas turbine engine stator assembly.

A gas turbine engine includes a compressor section having stator vanes. The stator vanes are supported relative to a compressor case by a hook arrangement, for example. It may be desirable in some applications to include an anti-rotation feature arranged between the compressor case and the stator vane to prevent rotation of the stator vane during engine operation.

Numerous anti-rotation lug configurations have been proposed. In one example, a rectangular block of material is brazed within an aperture of the compressor case. In another example, a racetrack-shaped slot is provided in the compressor case. A two-piece anti-rotation lug is inserted into the aperture. The first piece includes an arcuate recess at one end of the piece. A spring dowel is arranged in the aperture and in engagement with the arcuate recess to bias the anti-rotation lug against opposing arcuate surfaces of the aperture to retain the anti-rotation lug within the aperture. Both of these anti-rotation lug configurations are costly.

SUMMARY

In one exemplary embodiment, a stator assembly includes a case including an arcuate wall having an aperture with circumferentially spaced first lateral surfaces. A stator vane has an outer platform with a notch. An anti-rotation lug has a base that is received in the notch and a boss extends from the base. The boss is received in the aperture. The boss has second lateral surfaces that engage the first lateral surfaces in an interference fit relationship.

In a further embodiment of any of the above, the case includes a compressor case that is secured to a blade outer air seal by a fastener, and the outer platform includes a hook that is captured between the compressor case and the blade outer air seal.

In a further embodiment of any of the above, the stator assembly includes a damper spring that is supported on the hook and is arranged between the outer platform and the case.

In a further embodiment of any of the above, the base includes a relief cut that is provided about the boss to provide a pad that is in engagement with an inner surface of the case.

In a further embodiment of any of the above, a fillet is provided between the boss and the base. The fillet is spaced from the inner surface.

In a further embodiment of any of the above, the first lateral surfaces are parallel to one another and provide an aperture width. The second lateral surfaces are parallel with one another and provide a boss width. The boss width is greater than the aperture width.

In a further embodiment of any of the above, the first and second lateral surfaces are flat.

In a further embodiment of any of the above, the first lateral surfaces are joined by first arcuate surfaces opposite one another providing an aperture length. The second lateral surfaces are provided by second arcuate surfaces opposite one another and provide a boss length. The aperture length is greater than the boss length providing a clearance between the first arcuate surfaces and the second arcuate surfaces.

In another exemplary embodiment, an anti-rotation lug for a stator assembly includes a base that has a perimeter. A racetrack-shaped boss extends from a base. The boss is arranged within the perimeter. The boss includes spaced apart lateral surfaces joined on opposing sides by arcuate surfaces to provide the racetrack shape.

In a further embodiment of any of the above, the base includes a relief cut that is provided about the boss to provide a pad proud of the base surrounding the pad.

In a further embodiment of any of the above, a fillet is provided between the boss and the base.

In a further embodiment of any of the above, the lateral surfaces are parallel to one another.

In a further embodiment of any of the above, the lateral surfaces are flat.

In another exemplary embodiment, a method of assembling a stator assembly includes the steps of providing a compressor case with an aperture. The aperture includes first lateral surfaces that are parallel to one another that provide an aperture width. First lateral surfaces are joined by first arcuate surfaces opposite one another, providing an aperture length. The method includes the step of providing an anti-rotation lug with a boss. The boss includes second lateral surfaces that are parallel with one another and provide a boss width. The boss width is greater than the aperture width. The second lateral surfaces are joined by second arcuate surfaces opposite one another and providing a boss length. The aperture length is greater than the boss length. The method includes the step of press-fitting the boss into the aperture while providing a clearance between the first arcuate surfaces and the second arcuate surfaces.

In a further embodiment of any of the above, the method includes the step of assembling a stator relative to the compressor case with a notch of the stator that receives the anti-rotation lug.

In a further embodiment of any of the above, the method includes the step of securing a blade outer air seal relative to a compressor case to retain a hook of the stator within the case.

In a further embodiment of any of the above, the base includes a relief cut that is provided about the boss to provide a pad in engagement with an inner surface of the compressor case. A fillet is provided between the boss and the base. The fillet is spaced from the inner surface.

BRIEF DESCRIPTION OF THE DRAWINGS

The disclosure can be further understood by reference to the following detailed description when considered in connection with the accompanying drawings wherein.

DETAILED DESCRIPTION

Figure 1:
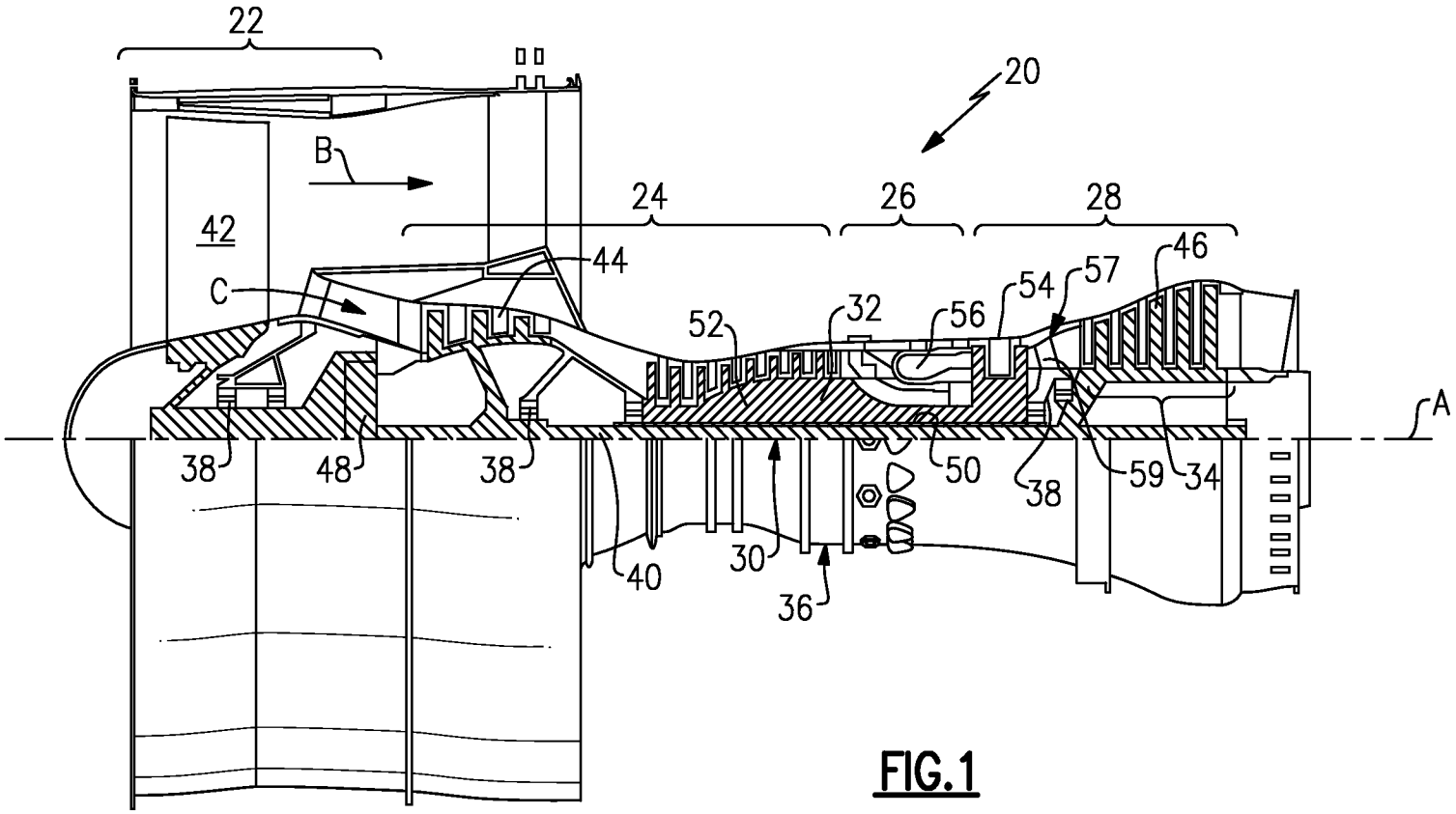
FIG. 1 schematically illustrates a gas turbine engine embodiment.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of [(Tram ° R)/518.7) 0.5]. The "Low corrected fan tip speed", as disclosed herein according to one non-limiting embodiment, is less than about 1150 ft/second.

Figure 2:
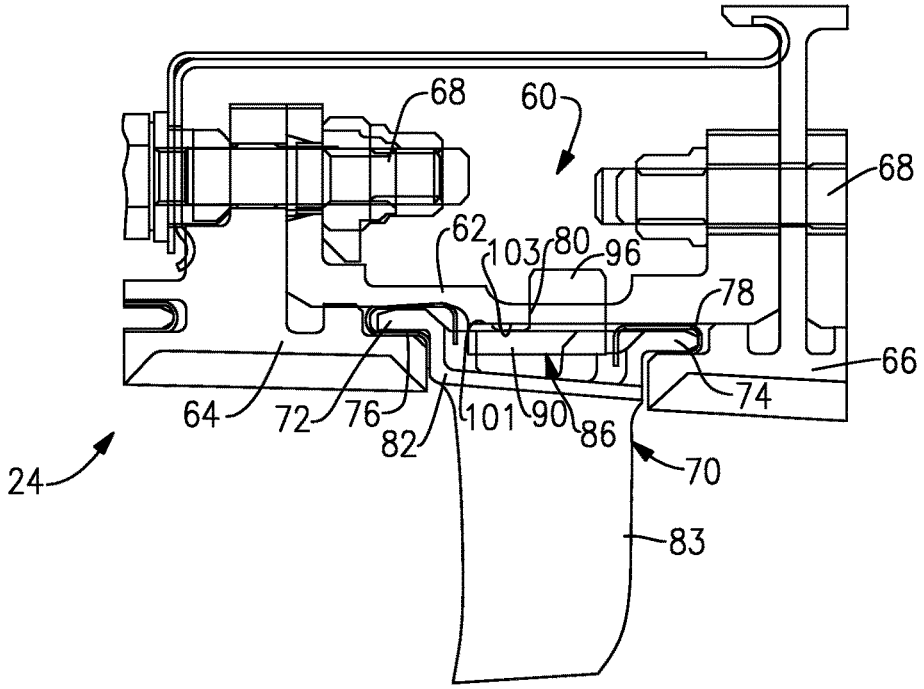
FIG. 2 is a cross-sectional view of a portion of a compressor section illustrating a stator assembly.
Figure 3:
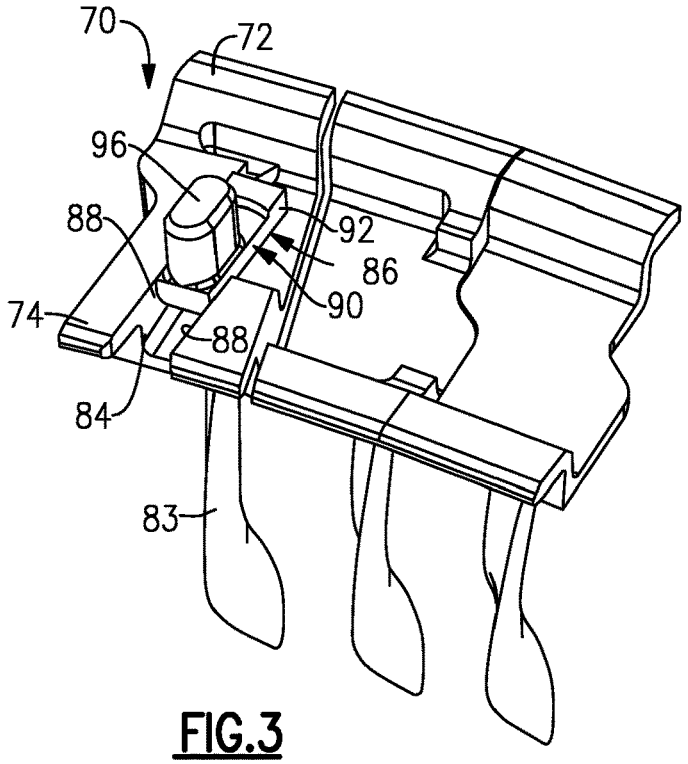
FIG. 3 is a perspective view of several singlet stators of the stator assembly.

FIG. 2 schematically illustrates a stator assembly 60 of a compressor section 24. The stator assembly 60 includes a compressor case 62 secured to first and second blade outer air seals (BOAS) 64, 66 by fasteners 68. However, it should be understood that other stator assembly configurations may include the compressor case and BOAS integrated within one another.

The stator assembly 60 includes an array of stators 70. In the example, the stator assembly 60 is provided by singlet stator vanes each having a discrete vane 83 extending radially inward from an outer platform 82. If desired, vane clusters may be used instead of singlet stator vanes. The outer platform 82 has fore and aft hooks 72, 74 captured between the compressor case 62 and the first and second BOAS 64, 66. Fore and aft damper springs 76, 78 are respectively arranged about the fore and aft hooks 72, 74 and within the surrounding support structure.

Figure 4:
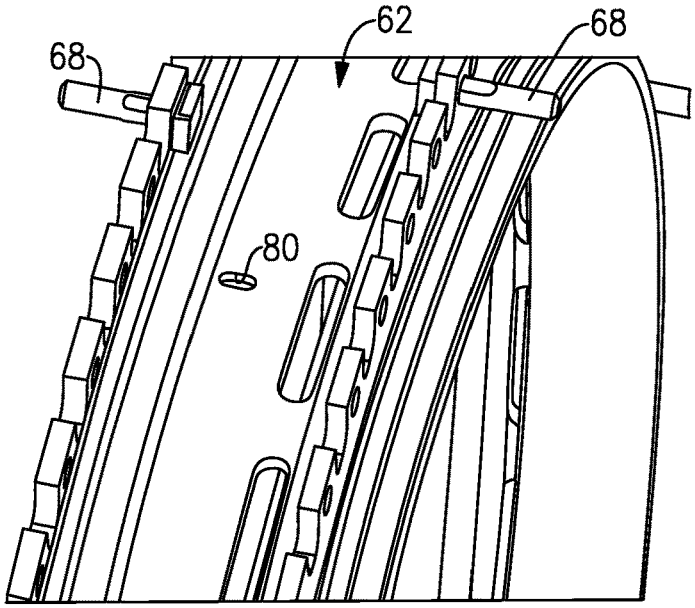
FIG. 4 is a perspective view of a portion of a compressor case.
Figure 5:
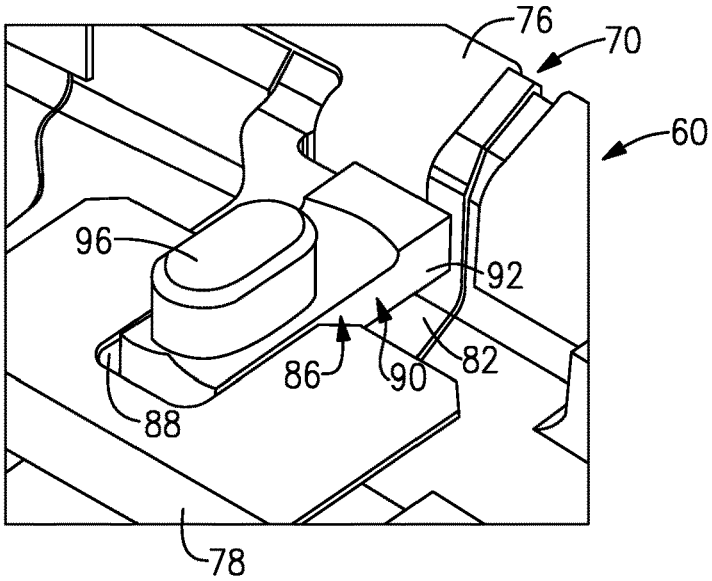
FIG. 5 is a perspective view of an anti-rotation lug within the stator assembly illustrated in FIG. 2.
Figure 6:
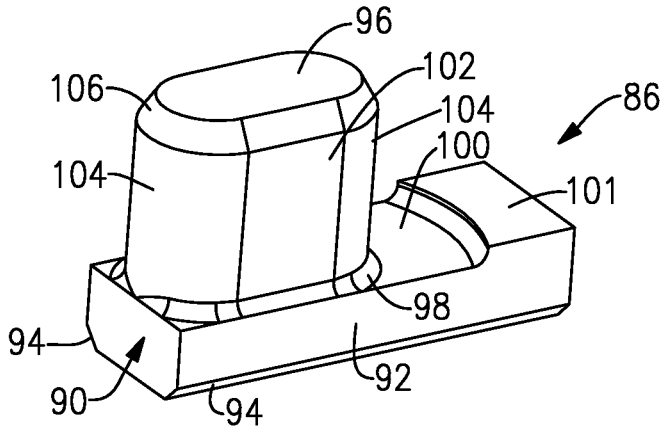
FIG. 6 is a perspective view of the anti-rotation lug shown in FIGS. 2 and 5.

Referring to FIGS. 2 and 4, the compressor case 62 includes circumferentially spaced apertures 80. In one example, eight apertures 80 are provided in the compressor case 62. The compressor case 62 includes an arcuate wall that may be provided by a single integral annular structure or multiple discrete arcuate portions secured to one another.

Referring to FIGS. 2-6, the outer platform 82 includes a notch 84 provided by spaced apart lateral walls 88. An anti-rotation lug 86 extends through the aperture 80 and is received in the notch 84 to prevent undesired circumferential movement of the stator 70 relative to the compressor case 62 during assembly. The anti-rotation lug 86 also prevents undesired rotation of the stator 70 with respect to the compressor case 62.

The anti-rotation lug 86 includes a base 90, which has a rectangular perimeter in the example. The base 90 provides lateral sides 92 that engage the lateral walls 88. Chamfers 94 may be provided on the base 90 to facilitate insertion of the stator 70 with respect to the anti-rotation lug 86 during assembly.

A boss 96 is integral with and extends from the base 90. A fillet 98 at least partially surrounds the boss 96 and adjoins the base 90. In the example, the boss 96 is arranged within the perimeter of the base 90. A relief cut 100 is provided in the base 90 about the boss 96 to provide a pad 101 that extends proud of the surrounding structure. The pad 101 engages an inner surface 103 of the compressor case 62 when the anti-rotation lug 86 has been inserted into the aperture 80 of the compressor case 62. The relief cut 100 is provided by an end mill cutter with a ball-nose, for example, which creates the fillet 98. The relief cut 100 spaces the fillet 98 radially inward from the inner surface to enable the anti-rotation lug 86 to be fully inserted into the aperture 80.

The interference fit ensures that the anti-rotation lug 86 will not fall out of the aperture 80 during assembly. The interference fit grows tighter as the temperature of the components increases during engine operation. The boss 96 is received within the aperture 80 in an interference fit.

The boss 96 has a racetrack-shaped cross-section that provides spaced apart lateral surface 102 joined by arcuate surfaces 104. The lateral surfaces 102 are flat and parallel to one another in the example. A chamfer 106 is provided at an end of the boss 96 opposite the base 90 to facilitate insertion of the anti-rotation lug 86 into the aperture 80 during assembly.

Figure 7:
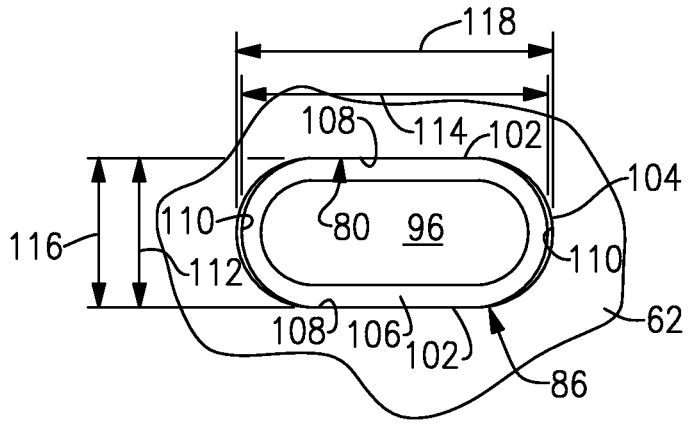
FIG. 7 is an end view of the anti-rotation lug within the compressor case.

Referring to FIG. 7, the aperture 80 is provided by a racetrack-shaped elongated opening having a similar shape to that of the boss 96. In the example, the aperture 80 is provided by lateral surfaces 108 that are parallel to one another and joined by arcuate surfaces 110.

The boss 96 includes a width 112 and a length 114. The aperture 80 includes a width 116 and a length 118. The boss width 112 is greater than the aperture width 116 to provide an interference fit at room temperature. In one example, the interference fit is 0.0001-0.0005 inch (0.0025-0.0127 mm). The aperture length 118 is greater than the boss length 114 to provide a clearance at either of the boss 96 between the arcuate surfaces 104, 110. Accordingly, the boss width 112 and the corresponding aperture width 116 provide the desired interference fit between the anti-rotation lug 86 and the aperture 80 using a single piece.

Although an example embodiment has been disclosed, a worker of ordinary skill in this art would recognize that certain modifications would come within the scope of the claims. For that reason, the following claims should be studied to determine their true scope and content.

What is claimed is:

1. A stator assembly comprising:

a case including an arcuate wall having an aperture with circumferentially spaced first lateral surfaces;

a stator vane having an outer platform with a notch;

an anti-rotation lug having a base received in the notch and a boss extending from the base, the boss received in the aperture, the boss having second lateral surfaces engaging the first lateral surfaces in an interference fit relationship; and wherein the first lateral surfaces are joined by first arcuate surfaces opposite one another and providing an aperture length, and the second lateral surfaces are provided by second arcuate surfaces opposite one another and providing a boss length, the second arcuate surfaces are convex and extend outward toward their respective first arcuate surface, the aperture length greater than the boss length providing a clearance between the first arcuate surfaces and the second arcuate surfaces.

2. The stator assembly according to claim 1, wherein the case includes a compressor case secured to a blade outer air seal by a fastener, and the outer platform includes a hook captured between the compressor case and the blade outer air seal.

3. The stator assembly according to claim 2, comprising a damper spring supported on the hook and arranged between the outer platform and the case.

4. The stator assembly according to claim 1, wherein the base includes a relief cut provided about the boss to provide a pad in engagement with an inner surface of the case.

5. The stator assembly according to claim 4, wherein a fillet is provided between the boss and the base, the fillet spaced from the inner surface.

6. The stator assembly according to claim 1, wherein the first lateral surfaces are parallel to one another and provide an aperture width, and the second lateral surfaces are parallel to one another and provide a boss width, the boss width greater than the aperture width.

7. The stator assembly according to claim 6, wherein the first and second lateral surfaces are flat.

8. A method of assembling a stator assembly comprising the steps of:

providing a compressor case with an aperture, wherein the aperture includes first lateral surfaces that are parallel to one another providing an aperture width, first lateral surfaces are joined by first arcuate surfaces opposite one another providing an aperture length;

providing an anti-rotation lug with a boss, the boss includes second lateral surfaces parallel with one another and providing a boss width, the boss width greater than the aperture width, the second lateral surfaces joined by second arcuate surfaces opposite one another and providing a boss length, the second arcuate surfaces are convex and extend outward toward their respective first arcuate surface, the aperture length greater than the boss length; and press-fitting the boss into the aperture while providing a clearance between the first arcuate surfaces and the second arcuate surfaces.

9. The method according to claim 8, comprising the step of assembling a stator relative to the compressor case with a notch of the stator receiving the anti-rotation lug.

10. The method according to claim 8, wherein the base includes a relief cut provided about the boss to provide a pad in engagement with an inner surface of the compressor case, and a fillet is provided between the boss and the base, the fillet spaced from the inner surface.

11. The method according to claim 8, wherein the compressor case includes a first circumferentially extending flange, and comprising the steps of providing a stator with a stator hook, and providing a blade outer air seal with a second circumferentially extending flange, and securing the first and second circumferentially extending flanges to one another to capture the stator hook between the compressor case and the blade outer air seal with the anti-rotation lug retained between the stator and the compressor case.

* * * * *